US008071170B2

(12) United States Patent
Kamimori et al.

(10) Patent No.: US 8,071,170 B2
(45) Date of Patent: Dec. 6, 2011

(54) METHOD OF FORMING MULTI-LAYERED PATTERNED COATING FILM

(75) Inventors: Isao Kamimori, Hiratsuka (JP); Ikumi Ono, Hiratsuka (JP); Takashi Kawasaki, Hiratsuka (JP)

(73) Assignee: Kansai Paint Co., Ltd., Amagasaki-Shi (KR)

( * ) Notice: Subject to any disclaimer, the term of this patent is extended or adjusted under 35 U.S.C. 154(b) by 1257 days.

(21) Appl. No.: 11/655,228

(22) Filed: Jan. 19, 2007

(65) Prior Publication Data

US 2007/0172692 A1 Jul. 26, 2007

(30) Foreign Application Priority Data

Jan. 23, 2006 (JP) ..... 2006-014093

(51) Int. Cl.

| | |
|---|---|
| ***B05D 5/06*** | (2006.01) |
| ***B05D 7/16*** | (2006.01) |
| ***B05D 1/36*** | (2006.01) |
| ***B05D 1/38*** | (2006.01) |

(52) U.S. Cl. ..... 427/258; 427/409; 427/421.1

(58) Field of Classification Search ..... 427/258, 427/287, 421.1, 427.4, 427.5

See application file for complete search history.

(56) References Cited

U.S. PATENT DOCUMENTS 6,291,018 B1 * 9/2001 Dattilo ..... 427/377

FOREIGN PATENT DOCUMENTS

| | | | |
|---|---|---|---|
| CA | 2230942 | | 9/1999 |
| EP | 0822011 | | 2/1998 |
| EP | 0835913 | | 4/1998 |
| EP | 1 595 604 | A1 * | 11/2005 |
| EP | 1595604 | | 11/2005 |
| GB | 2399040 | | 9/2004 |
| JP | 5-237444 | | 9/1993 |
| JP | 9-310038 | | 12/1997 |
| JP | 10-043675 | | 2/1998 |
| JP | 10-216618 | | 8/1998 |
| JP | 10-216618 | A * | 8/1998 |
| JP | 2000-296360 | | 10/2000 |
| JP | 2000-297255 | | 10/2000 |
| JP | 2001-162220 | | 6/2001 |
| JP | 2003-117481 | | 4/2003 |
| JP | 2004-154610 | | 6/2004 |
| JP | 2004-351389 | A * | 12/2004 |

OTHER PUBLICATIONS

European Search Report dated Apr. 17, 2007.
Japanese Office Action mailed Aug. 2, 2011.

* cited by examiner

*Primary Examiner* — William Phillip Fletcher, III
(74) *Attorney, Agent, or Firm* — Kratz, Quintos & Hanson, LLP

(57) ABSTRACT

The present invention provides methods of forming multi-layered patterned coating films comprising the steps of (1) applying a first colored base coating composition to a substrate, (2) applying a second colored base coating composition over the uncured coating film of the first colored base coating composition in such a manner that the first colored base coating film is partially exposed, the second colored base coating composition being able to form a coating film of different color and/or visual texture from that of the first colored base coating composition, and having, 30 seconds after application, 30 to 60 mass % of the solids content of the base coating composition, and (3) applying a top clear coating composition over the cured or uncured first and second colored base coating compositions, and curing the uncured composition(s).

11 Claims, No Drawings

METHOD OF FORMING MULTI-LAYERED PATTERNED COATING FILM

BACKGROUND OF THE INVENTION

1. Field of the Invention

The present invention relates to methods of forming multi-layered patterned coating films.

2. Description of Related Art

Coatings are usually applied to automotive bodies, household electrical appliances, furniture, and like industrial products for protection and aesthetic purposes.

In recent years, innovative designs have been sought to enhance the appearance of such industrial products. Innovative designs herein mean, for example, nature-themed designs, artificial designs, traditional designs, and the like. Examples of nature-themed designs include a leather patterned appearance, stone patterned appearance, wood-grain patterned appearance, metallic appearance, marbled appearance, fur patterned appearance, fabric patterned appearance, "Washi" Japanese paper patterned appearance, etc. Examples of artificial designs include geometric patterns, etc. Examples of traditional designs include "Tsugaru Lacquering" patterned appearance, "mother-of-pearl work" patterned appearance, etc. "Tsugaru Lacquering" is a craft wherein distinctive patterns are created by applying layers of "urushi" Japanese lacquer and sanding them. "Mother-of-pearl work" is an "urushi" work which uses pearly inlays of processed shells such as abalone, mother-of-pearl, etc., and provides a high-quality appearance.

However, it is difficult to apply designs such as nature-themed designs and traditional designs to mass-produced industrial products because the application of these designs requires complicated steps. For this reason, easy methods of applying innovative designs to industrial products have been sought.

Unexamined Japanese Patent Publication No. 1998-43675 discloses an application method for forming a patterned layer comprising the steps of applying a metallic base coating composition to a substrate such as an automotive body or the like, and applying a pattern-forming coating composition to the surface of the base coating film to a film thickness thinner than its hiding film thickness. However, since the pattern-forming coating composition is applied by jet printing in this method, only a limited range of patterns can be formed.

Unexamined Japanese Patent Publication No. 2000-296360 discloses a method of forming a dot-patterned coating film comprising applying two or more kinds of coating compositions such as high-gloss solid color coating compositions, low-gloss solid color coating compositions, highly lustrous metallic coating compositions, etc. with a spray gun equipped with a plurality of coating nozzles. However, the patterns of coating films formed by this method are limited to dotted patterns, and since the method uses a single-layered coating film, only a limited range of designs can be formed.

BRIEF SUMMARY OF THE INVENTION

An object of the present invention is to provide a method of a forming multi-layered patterned coating film which enables easy formation of a patterned coating film with a three-dimensional effect and an impression of high-quality, and having different colors and/or visual textures.

The present inventors conducted intensive research to achieve the above object. As a result, they found that the object can be achieved by applying a first colored base coating composition to a substrate, then applying a specific second colored base coating composition in such a manner that uncured coating film of the first colored base coating composition is partially exposed, and further applying a top clear coating composition. The present invention was accomplished based on such findings.

The present invention provides methods of forming multi-layered patterned coating films.

1. A method of forming a multi-layered patterned coating film comprising the steps of (1) applying a first colored base coating composition to a substrate, (2) applying a second colored base coating composition over the uncured coating film of the first colored base coating composition in such a manner that the first colored base coating film is partially exposed, the second colored base coating composition being able to form a coating film of different color and/or visual texture from that of the first colored base coating composition, and having, 30 seconds after application, 30 to 60 mass % of the solids content of the base coating composition, and (3) applying a top clear coating composition over the cured or uncured first and second colored base coating compositions, and curing the uncured composition(s).

2. A method of forming a coating film according to claim 1, wherein the second colored base coating composition is a luster coating composition.

3. A method of forming a coating film according to claim 1, wherein two or more kinds of coating compositions capable of forming a coating film of different colors and/or visual textures are applied as the second colored base coating composition.

4. A method of forming a coating film according to claim 3, wherein a spray gun equipped with a plurality of coating nozzles is employed to apply the two or more kinds of coating compositions.

5. A method of forming a coating film according to claim 1, wherein the proportion of area exposed of the first colored coating film after the application of the second colored base coating composition is about 1% to about 95%.

6. A method of forming a coating film according to claim 1, wherein the colors and/or visual textures of the coating films obtained by individually applying the first and second colored base coating compositions meet at least one requirement selected from the group consisting of (i) the lightness value difference, $\Delta L^*$, is 5 or higher on the L*C*h Color Scale, (ii) the hue angle value difference, $\Delta h$, is 45 or higher on the L*C*h Color Scale, and (iii) the flip-flop value difference, $\Delta FF$, is 0.2 or higher.

7. A method of forming a coating film according to claim 1, wherein the uncured coating film of the first colored base coating composition in step (2) has a solids content of 40 mass % or greater.

8. A method of forming a coating film according to claim 1, wherein in step (3) the first and second colored base coating films are cured, and the top clear coating composition is then applied over these films and cured.

9. A method of forming a coating film according to claim 1, wherein in step (3) the first and second colored base coating composition films are left uncured, and the top clear coating composition is then applied over these coating films, and these three coating film layers are cured simultaneously.

10. A method of forming a coating film according to claim 1, wherein the top clear coating composition contains a gloss control agent.

11. A method of forming a coating film according to claim 1, wherein the substrate is an automotive body or automobile interior part.

12. A coated product on which a patterned coating film is formed by the method of forming a multi-layered patterned coating film according to claim 1.

DETAILED DESCRIPTION OF THE INVENTION

Substrates

Usable substrates to be coated include automotive bodies, automobile interior parts, household electrical appliances, furniture, etc. Such substrates further include metal materials for forming the above-mentioned automotive bodies and the like, such as cold-rolled steel sheets, galvanized steel sheets, zinc alloy-plated steel sheets, stainless steel sheets, tinned steel sheets and other steel sheets, aluminum sheets, aluminum alloy sheets, magnesium sheets, magnesium alloy sheets, etc.; molded plastic materials, plastic foams and other plastic substrates; and glass substrates and the like.

Also usable are those whose surface has been subjected to degreasing treatment and/or a chemical conversion treatment such as phosphate treatment, chromate treatment and/or the like. Usable substrates may further be coated with an undercoat such as a cationic electrodeposition coating and primer coating to impart hiding properties, anti-corrosion properties, etc. Furthermore, usable substrates may be coated with an intermediate coat such as a thermosetting intermediate coat or the like on the undercoat to enhance chipping resistance, interlayer adhesion, etc. The undercoat and/or intermediate coat may or may not be cured.

First Colored Base Coating Composition

In the method of forming coating film of the present invention, the first colored base coating composition is a coating composition directly or via an undercoat, etc. applied to a substrate, and forms on the substrate a solid color coating film caused by a coloring pigment or a luster coating film caused by a coloring pigment and a luster pigment.

Usable first colored base coating compositions are liquid thermosetting coating compositions and ambient temperature curing coating compositions, each containing resin components, coloring pigments, solvents, and/or the like. Such resin components typically contain a base resin and, if required, a crosslinking agent. Examples of types of base resins include acrylic resins, polyester resins, alkyd resins, urethane resins, etc. The base resins preferably contain crosslinkable functional group(s). Examples of crosslinkable functional groups include hydroxy, epoxy, carboxy, silanol, etc. Examples of crosslinking agents include melamine resins, urea resins, polyisocyanate compounds, blocked polyisocyanate compounds, etc. Usable solvents are known organic solvents for coating composition and/or water. Resin components and coloring pigments can be used dissolved or dispersed in such solvents.

Known coloring pigments for inks and paints can be used singly or in combination.

Specific examples of these coloring pigments in terms of Color Index (C.I.No.) are as shown below, but are not limited thereto.

White pigments Pigment White 1, Pigment White 4, Pigment White 6, etc.

Black pigments: Pigment Black 1, Pigment Black 6, Pigment Black 7, Pigment Black 10, Pigment Black 11, Pigment Black 31, Pigment Black 32, etc.

Blue pigments: Pigment Blue 15, Pigment Blue 15:1, Pigment Blue 15:2, Pigment Blue 15:3, Pigment Blue 15:4, Pigment Blue 15:6, Pigment Blue 16, Pigment Blue 28, Pigment Blue 29, Pigment Blue 60, Pigment Blue 75, Pigment Blue 80, Pigment Violet 2.3, etc.

Green pigments: Pigment Green 7, Pigment Green 36, Pigment Green 37, etc.

Red pigments: Pigment Red 3, Pigment Red 48:2, Pigment Red 48:3, Pigment Red 48:4, Pigment Red 52:2, Pigment Red 88, Pigment Red 101, Pigment Red 104, Pigment Red 112, Pigment Red 122, Pigment Red 146, Pigment Red 168, Pigment Red 170, Pigment Red 177, Pigment Red 178, Pigment Red 179, Pigment Red 188, Pigment Red 202, Pigment Red 206, Pigment Red 207, Pigment Red 214, Pigment Red 224, Pigment Red 242, Pigment Red 251, Pigment Red 253, Pigment Red 254, Pigment Red 255, Pigment Red 256, Pigment Red 257, Pigment Red 264, Pigment Red 279, Pigment Violet 19, Pigment Violet 29, etc.

Orange pigments: Pigment Orange 5, Pigment Orange 36, Pigment Orange 43, Pigment Orange 62, Pigment Orange 67, etc.

Brown pigments: Pigment Brown 24, Pigment Brown 25, etc.

Yellow pigments: Pigment Yellow 1, Pigment Yellow 3, Pigment Yellow 16, Pigment Yellow 34, Pigment Yellow 42, Pigment Yellow 53, Pigment Yellow 74, Pigment Yellow 75, Pigment Yellow 79, Pigment Yellow 81, Pigment Yellow 83, Pigment Yellow 109, Pigment Yellow 110, Pigment Yellow 129, Pigment Yellow 138, Pigment Yellow 139, Pigment Yellow 150, Pigment Yellow 151, Pigment Yellow 154, Pigment Yellow 155, Pigment Yellow 173, Pigment Yellow 184, Pigment Yellow 213, etc.

Also usable are those with a known surface treatment applied to an above coloring pigment. Such surface treatments are, for example, acid/base treatment, coupling agent treatment, plasma treatment, oxidation-reduction treatment, etc.

In light of a good hiding properties and finished appearance of the obtained coating film, the amount of the coloring pigment(s) is preferably about 0.5 to about 100 mass parts, and more preferably about 1 to about 50 mass parts, per 100 mass parts of resin component solids contained in the first colored base coating composition.

The first colored coating composition can further contain a luster pigment, if required, to impart luster and to enhance three-dimensional effects.

Known luster pigments for inks and paints can be used singly or in combination.

Specific examples of such luster pigments include flaky metallic pigments such as aluminum, copper, nickel alloys, stainless steel, etc.; flaky metallic pigments with metal oxide-covered surfaces; flaky metallic pigments with coloring pigments chemically adsorbed onto their surface; flaky aluminum pigments with an aluminum oxide layer formed by a surface oxidation-reduction reaction; colored aluminum pigments covered with coloring pigments or inorganic metal oxides; glass flake pigments; glass flake pigments having their surface covered with metals or metal oxides; glass flake pigments with coloring pigments chemically adsorbed onto the surface; interference mica pigments having their surface covered with titanium dioxide; reduced mica pigments obtained by reducing and coloring interference mica pigments; colored mica pigments with coloring pigments chemically adsorbed onto their surfaces; colored mica pigments with iron oxide-covered surfaces; graphite pigments with titanium dioxide-covered surfaces; silica flake pigments with titanium dioxide-covered surfaces; alumina flake pigments with titanium dioxide-coated surfaces; plate-like iron oxide pigments; holographic pigments; synthetic mica pigments; helical cholesteric liquid crystal polymer pigments; etc. Luster pigments are not limited to these examples, and can be used singly or two or more can be used in combination, depending on the luster desired.

To achieve highly metallic effects, preferable among these luster pigments are flaky metallic pigments such as aluminum, copper, nickel alloys, stainless steel, etc.; flaky metallic pigments with metal oxide-covered surfaces; flaky metallic pigments with coloring pigments chemically adsorbed onto their surfaces; colored mica pigments with coloring pigments chemically adsorbed onto their surfaces; colored mica pigments with iron oxide-covered surfaces; etc. More preferable are aluminum flake pigments; and aluminum flake pigments with metal oxide-covered surfaces, etc.

In light of a good luster and finished appearance of the obtained coating film, the amount of such luster pigment(s) is preferably about 0.5 to about 100 mass parts, more preferably about 1 to about 50 mass parts, per 100 mass parts of resin component solids in the first colored base coating composition.

The first colored base coating composition may further contain, if required, various additives such as rheology control agents, pigment dispersants, sedimentation inhibitors, curing catalysts, antifoaming agents, antioxidants, ultraviolet absorbers, etc.; body pigments; gloss control agents; etc.

The first colored base coating composition can be prepared by mixing the components described above. The first colored base coating composition is usually prepared for coating to have a solids content of preferably about 15 to about 50 mass %. When the solids content is within this range, the viscosity of the coating composition is usually within the range of about 10 to about 40 seconds by a Ford cup #4 (20° C.). The solids content is more preferably adjusted to be about 20 to about 40 mass %.

The first colored base coating composition can be applied by a method such as electrostatic coating, air spray coating, airless spray coating, or the like. For good smoothness, the thickness of the applied composition is preferably about 5 to about 50 μm, and more preferably about 10 to about 40 μm, when cured. The film of the first colored base coating composition can be cured at ambient temperature or heat-cured at about 60 to about 150° C.

Second Colored Base Coating Composition

In the method of forming coating film of the present invention, the second colored base coating composition is a coating composition applied over a part of the uncured coating film of the first colored base coating composition. When the second colored base coating composition is applied in such a manner, partially exposed areas of the first colored base coating film and migration of the second colored base coating composition into the uncured film of the first colored base coating composition together enable the formation of complicated patterns.

The second colored base coating composition forms a solid color coating film caused by a coloring pigment or a luster coating film caused by a luster pigment alone or by a coloring pigment and luster pigment. Luster coating films enable the formation of multi-layered patterned coating films with good three-dimensional effects such as depth, relief, etc.

Usable second colored base coating compositions are liquid thermosetting coating compositions and ambient temperature curing coating compositions, each containing resin components, coloring pigments and/or luster pigments, solvents, etc.

Usable resin components are those exemplified as resin components contained in the first colored base coating composition.

Known coloring pigments for inks and paints can be used singly or in combination. More specifically, those listed as coloring pigments for the first colored base coating composition can also be used. In light of a good finished appearance of the obtained coating film, the amount of such coloring pigment(s) is preferably about 0.5 to about 50 mass parts, and more preferably about 1 to about 30 mass parts, per 100 solids mass parts of the resin component in the second colored base coating composition.

Known luster pigments for inks or paints can be used singly or in combination. More specifically, those exemplified as the luster pigments contained in the first colored base coating composition can also be used. In light of a good luster and finished appearance of the obtained coating film, the amount of such luster pigment(s) is preferably about 0.5 to about 100 mass parts, and more preferably about 1 to about 50 mass parts, per 100 mass parts of resin component solids contained in the second colored base coating composition.

Usable solvents are known organic solvents for paints and/or water.

The second colored base coating composition may further contain, if required, various additives such as rheology control agents, pigment dispersants, sedimentation inhibitors, curing catalysts, antifoaming agents, antioxidants, ultraviolet absorbers, etc.; body pigments; gloss control agents; etc.

The second colored base coating composition can be prepared by mixing the components described above. The second colored base coating composition is usually prepared for coating to have a solids content of preferably about 10 to about 50 mass %. When the solids content is within this range, the viscosity of the coating composition is usually within the range of about 10 to about 40 seconds by a Ford cup #4 (20° C.). The solids content is more preferably adjusted to be about 15 to about 40 mass %.

The second colored base coating composition can be applied by a method such as electrostatic coating, air spray coating, airless spray coating, or the like. The thickness of the applied composition is not limited as long as a patterned coating film can be formed. The film of the second colored base coating composition can be cured at ambient temperature or heat-cured at about 60 to about 150° C.

Top Clear Coating Composition

In the method of forming coating film of the present invention, the top clear coating composition is a coating composition applied over cured or uncured first and second colored base coating compositions (films).

The top clear coating composition applied covers and smoothes out a patterned coating film formed from the first and second colored base coating compositions, and can impart properties such as weather resistance, water resistance, chemical resistance, etc.

Usable top clear coating compositions are liquid thermosetting coating compositions and ambient temperature curing coating compositions, each containing resin components, solvents, etc.

The resin component typically contains a base resin and crosslinking agent. Examples of type of base resins include acrylic resins, polyester resins, alkyd resins, urethane resins, silicon-containing resins, etc. The base resins preferably contain crosslinkable functional group(s). Examples of crosslinkable functional groups include hydroxy, carboxy, silanol, epoxy, etc. Examples of usable crosslinking agents include melamine resins, urea resins, polyisocyanate compounds, blocked polyisocyanate compounds, epoxy compounds and resins, carboxy-containing compounds and resins, acid anhydrides, alkoxysilane-containing compounds and resins, etc., all having reactive group(s) capable of reacting with functional group(s) in the base resin.

Usable solvents are known organic solvents for paints and/or water.

The top clear coating composition may contain, if required, various additives such as curing catalysts, antifoaming agents, ultraviolet absorbers, etc.

The top clear coating composition may further contain coloring pigments, dyes, gloss control agents, etc. in the range in which transparency is not impaired.

Known coloring pigments for inks and paints can be contained in the top clear coating composition singly or in combination. More specifically, those exemplified as coloring pigments for the first colored base coating composition can also be used. When coloring pigments are contained, in light of intact transparency and a good finished appearance of the obtained coating film, the amount is preferably about 0.001 to about 5 mass parts, and more preferably about 0.01 to about 3 mass parts, per 100 mass parts of resin component solids in the top clear coating composition.

Known dyes for inks, paints and plastic molded articles can be contained in the top clear coating composition singly or in combination. Specific examples of such dyes include azo dyes, anthraquinone dyes, copper phthalocyanine dyes, metal complex dyes, etc. When dye is contained, in light of adjustability of hue angles and a good finished appearance of the obtained coating film, the amount is preferably about 0.001 to about 5 mass parts, and more preferably 0.01 to about 3 mass parts, per 100 mass parts of resin component solids in the top clear coating composition.

Known gloss control agents for inks and paints can be contained in the top clear coating composition singly or in combination. Specific examples include inorganic fine particles such as powdery silica, particulate silica, ceramic powders, and the like; fine resin particles such as acrylic resins, urethane resins, and the like; etc. However, examples are not limited to the above. When a top clear coating composition containing a gloss control agent is applied, a coating film with soft visual texture due to suppressed glossiness can be formed. When a gloss control agent is contained, in light of adjustability of luster value and a good finished appearance of the obtained coating film, the amount is preferably about 1 to about 60 mass parts, and more preferably about 3 to about 30 mass parts, per 100 mass parts of resin component solids in the top clear coating composition.

The top clear coating composition can be prepared by mixing the components described above. The top clear coating composition is typically prepared for application to have a solids content of preferably about 10 to about 50 mass %. When the solids content is within this range, a viscosity of the coating composition is usually within the range of about 10 to about 40 seconds by a Ford cup #4 (20° C.). The solids content is more preferably adjusted to be about 15 to about 40 mass %.

The top clear coating composition can be applied by a method such as electrostatic coating, air spray coating, airless spray coating, or the like. For good smoothness, the thickness of the applied composition is preferably about 10 to about 50 μm, and more preferably about 10 to about 40 μm, when cured. The film of the top clear coating composition can be cured at ambient temperature or heat-cured at about 60 to about 150° C.

Steps for Forming Multi-Layered Patterned Coating Film

The method of forming a multi-layered patterned coating film of the present invention comprises the steps of (1) applying a first coloring base coating composition to a substrate, (2) applying a second colored base coating composition over the uncured coating film of the first colored base coating composition in such a manner that the first colored base coating film is partially exposed, the second colored base coating composition being able to form a coating film of different color and/or visual texture from that of the first colored base coating composition, and having, 30 seconds after application, 30 to 60 mass % of the solids content of the base coating composition, and (3) applying a top clear coating composition over the cured or uncured first and second colored base coating compositions, and curing the uncured composition(s).

Step (1)

Step (1) is a step for applying the first colored base coating composition to a substrate. The first colored base coating composition is applied by a method such as electrostatic coating, air spray coating, airless spray coating, or the like. The coating film thickness is preferably about 5 to about 50 μm on a cured film basis. After the application, it is preferable that the applied composition be allowed to stand for usually about 1 to about 6 minutes.

Step (2)

Step (2) is a step for applying the second colored base coating composition over a part of the uncured coating film of the first colored base coating composition formed in step (1). To enable easy pattern formation by the second colored base coating composition, the uncured coating film of the first colored base coating composition when applied has a solids content of preferably at least 40 mass %, and more preferably about 55 to about 90 mass %.

The second colored base coating composition is applied by a method such as electrostatic coating, air spray coating, airless spray coating, or the like. The thickness of the applied composition is not limited as long as a patterned coating film can be formed, but it is usually preferable that the film thickness be about 5 to about 30 μm. After application, the applied composition is preferably allowed to stand about 3 to about 15 minutes.

When the second colored base coating composition is applied over an uncured coating film of the first colored base coating composition in such a manner that the uncured coating film is partially exposed, mixing of the layers of these coating films causes migration of the second colored base coating composition on the uncured coating film of the first colored base coating composition in the course of curing. The partially exposed first colored base coating composition, the second colored base coating composition, and the migration caused by these base coating compositions together form complicated patterns.

It is essential that the solids content of the second colored base coating composition be within the range of about 30 to about 60 mass % 30 seconds after its application. When the solids content of the applied second colored base coating composition is less than this range, the layers mix excessively resulting in unclear patterns. When the solids content is higher than this range, the layers do not mix, forming hardly any patterns by migration. The solids content of the second colored base coating composition 30 seconds after application is preferably within the range of about 40 to about 50 mass %.

The solids contents of the applied first and second colored base coating compositions can be, for example, measured as follows. An aluminum foil whose mass is premeasured is covered with a flat magnet whose center is cut out in such a manner that ascertain area is exposed leaving the magnet's outer periphery intact, and a coating composition is applied to the exposed area. The flat magnet is removed 30 seconds after the application of the composition. The aluminum foil is immediately folded so that solvent does not further evaporate, and quickly measured for its mass. The aluminum foil is then opened and the coating composition is cured under the same conditions as for the coating film in the present invention, followed by measurement of the mass. The solids content of the applied composition is calculated from the masses of the coating compositions before and after curing and the premeasured mass of the aluminum foil.

The solids content of an applied composition can be adjusted by suitably selecting the solvent composition of the coating composition. More specifically, desired solids contents in applied coating compositions can be obtained by varying mixing ratios of solvents with high and low boiling points.

The second colored base coating composition used in the present invention is a coating composition capable of forming a coating film of different color and/or visual texture from that of the coating film of the first colored base coating composition.

The color is specified based on lightness, chroma, and hue. Visual textures herein mean glossiness, light transmissivity, IV value, SV value, FF value, etc. Colors can be expressed by chromaticity and lightness in terms of color spaces such as the Munsell notation system, the L*a*b* color system, the L*C*h Color Scale, the XYZ color system, etc. Visual textures can be expressed by glossiness and light transmissivity of coating films; IV and SV values indicating metallic effects of luster coating films; the flip-flop value (FF value) indicating a difference in lightness depending on the angle of vision. These characteristics can be determined using commercial calorimeters, spectrophotometers, glossmeters, etc., and calculated based on measured values.

Luster coating compositions can advantageously be used as the second colored base coating composition due to good three-dimensional effects such as depth, relief, and the like of the obtained multi-layered patterned coating film.

In step (2), two or more kinds of coating compositions capable of forming coating films of different colors and/or visual textures are preferably used as the second colored base coating composition, with use of two to four kinds of coating compositions being more preferable. When two or more kinds of second colored base coating compositions of different colors and/or visual textures are used, these coating compositions together with the color(s) and/or visual texture(s) of the first colored base coating composition can form a patterned coating film with various colors and/or visual textures co-existing, thereby resulting in good three-dimensional effects, etc.

When two or more kinds of the second colored base coating compositions are used, they can be applied using a spray gun equipped with a plurality of coating nuzzles. Such a spray gun has a main body with a coating gun head equipped with two or more, and preferably two to four, coating nozzles. Each coating nozzle discharges a coating composition of different color to form patterns with different co-existing colors. An example of such a spray gun is disclosed in Japanese Unexamined Patent Publication No. 1997-299833.

When the application is performed using a spray gun equipped with a plurality of coating nozzles, application conditions for each coating nozzle are desirably adjusted in the range of about 80 to about 300 NL/min pattern air quantities, and about 80 to about 300 NL/min atomized air quantity for coating. Each coating nozzle may or may not have identical atomized air quantities and pattern air quantities. Atomized air quantities and pattern air quantities can be adjusted as desired in accordance with the distance between the spray gun and the substrate. Further, the speed of spray gun movement can be appropriately adjusted depending on the intended coating color.

In the method of the present invention, in light of good design versatility of the obtained patterned coating film, the coating film of the first colored base coating composition preferably has a proportion of exposed area of about 1 to about 95% after the application of the second colored base coating composition. The proportion of the exposed area is preferably about 5 to about 85%, and more preferably about 15 to about 80%.

In the method of the present invention, in light of good design versatility of the obtained patterned coating film, the colors and/or visual textures of the coating films obtained by individually applying the first and second colored base coating compositions meet preferably at least one, and more preferably two or more requirements selected from the group consisting of (i) the lightness value difference, ΔL*, is 5 or higher on the L*C*h Color Scale, (ii) the hue angle value difference, Δh, is 45 or higher on the L*C*h Color Scale, and (iii) the flip-flop value difference, ΔFF, is 0.2 or higher.

The L*C*h* Color Scale was developed by the Commission Internationale de l'Eclairage, and is described in Section 4.2 of CIE Publication 15.2 (1986). According to the L*C*h* Color Scale, L* denotes lightness, and h denotes hue angle, the angle in a counterclockwise direction from the red axis, which is defined as being 0°, on the CIE L*C*h color space diagram. The lightness L and hue angle h can be measured using chroma meters, multiangle spectrophotometers, etc. Examples of usable chroma meters include commercial models such as the CR series (tradename) manufactured by Konica Minolta Holdings, Incorporated, the "SM Color Computer" (tradename) manufactured by Suga Test Instruments Co., Ltd., etc. Examples of usable multiangle spectrophotometers include commercial models such as the "MA-68" (tradename) manufactured by X-Rite Incorporated, etc.

The flip-flop value indicates a difference in lightness varying-depending on the angle of vision, and is particularly significant in luster coating films. The flip-flop value can be, for example, measured using multiangle spectrophotometers, etc. Examples of usable multiangle spectrophotometers include commercial models such as the "MA-68". Multiangle spectrophotometers are able to measure spectral reflectance when incident light at an angle of 45° to the surface of a coating film is received at angles of 15°, 25°, 45°, 75° and 110° to the specular light.

In the present invention, the flip-flop value (FF value) is calibrated by numerical formula (1) below, using the L* value calculated based on the spectral reflectance at the light-receiving angle of 15° (referred to as "L15") and the L* value calculated based on the spectral reflectance at a light-receiving angle of 45° (referred to as "L45"). The L* value herein means an L* value in terms of the L*a*b* color system defined in JIS Z8729.

$$\text{FF Value}=[2\times(L15-L45)]/(L15+L45) \quad (1)$$

In the method of the present invention, the colors and/or visual textures of coating films obtained by independently applying the first colored base coating composition and the second colored base coating composition means the colors and/or visual textures of coating films measured by the above measurement method. A coating composition for which the colors and visual textures of coating films are to be measured is applied to a plate with a gray coating film formed thereon to a film thickness of 30 μm (when cured), allowed to stand at room temperature for 10 minutes, and heat-cured at 140° C. for 30 minutes in a dryer oven with internal air circulation. The color gray herein is a color identified with an N value of 5.5 on the Munsell notation system measured with a multiangle spectrophotometer.

Step (3)

Step (3) is a step for applying a top clear coating composition over the first and second colored base coating films with or without these having been cured.

The top clear coating composition can be applied by a method such as electrostatic coating, air spray coating, airless spray coating, or the like. In light of good smoothness, the film thickness of the applied composition, when cured, is preferably about 10 to about 50 μm, and more preferably about 10 to about 40 μm. After application, the applied composition is preferably allowed to stand usually about 3 to about 20 minutes.

In step (3), the first and second colored coating base coating films are usually heated at about 60 to about 150° C. for about 20 to about 40 minutes for simultaneous curing, and the top clear coating composition is subsequently applied and heat-cured usually at about 60 to about 150° C. for about 20 to about 40 minutes.

Alternatively, in step (3), the top clear coating composition is applied over uncured first and second colored base coating films, and the first and second colored base coating films and top clear coating film can be heat-cured simultaneously usually at about 60 to about 150° C. for about 20 to about 40 minutes.

A multi-layered patterned coating film with different colors and/or visual textures is thus obtained.

Effects of the Invention

According to the methods of forming multi-layered patterned coating films of the present invention, the following effects can be achieved.

(1) A multi-layered patterned coating film with different colors and/or visual textures co-existing, and having excellent three-dimensional effects such as depth, relief, and the like, can be easily formed.

In particular, a patterned coating film with colorful designs and with an impression of high-quality can be formed because the first colored base coating film surface is partially exposed from the second colored base coating film surface, there is migration of the second colored base coating film to the first colored base coating film, and different colors and visual textures are mixed together.

(2) When a top clear coating composition containing a gloss control agent is applied over the first and second colored base coating films, a patterned coating film with a soft visual texture of suppressed glossiness can be formed.

EXAMPLES

The present invention is further illustrated with reference to the following Production Examples, Examples and Comparative Examples. However the invention is not limited to these examples. In these examples, parts and percentages are by mass, in principle.

Production Example 1

Production of Substrate

A cationic electrodeposition coating composition (tradename "Elecron 9400HB", product of Kansai Paint Co., Ltd., containing an epoxy resin/polyamine-based cationic resin and a blocked polyisocyanate compound as a curing agent) was applied by electrodeposition to a degreased and zinc phosphate-treated steel plate (JIS G 3141, sized 400×300×0.8 mm) to a film thickness of 20 μm when cured, and heat-cured at 170° C. for 20 minutes.

An intermediate coating composition (tradename "LUGABAKE INTERMEDIATE COATING GRAY", Kansai Paint Co., Ltd., a polyester resin/melamine resin organic solvent-based coating composition) was applied by air spraying to the surface of the cured electrodeposited coating to a thickness of 30 μm when cured, heat-cured at 140° C. for 30 minutes to obtain a substrate with an intermediate coating film formed thereon.

Production Examples 2 to 8

Production of Colored Base Coating Compositions Nos. 1 to 7

At least one of the kinds and amounts of coloring pigments and luster pigments shown in Table 1 was admixed with stirring per 100 parts (solids content) of a resin component consisting of 70 parts of a hydroxy-containing acrylic resin (hydroxy value 100 mg KOH/g, number average molecular weight 20,000) and 30 parts of a butylated melamine resin (number average molecular weight 2,000), diluted to an appropriate viscosity so as to have solvent compositions as shown in Table 1, thereby producing organic solvent-based colored base coating compositions Nos. 1 to 7 having solids contents of about 25%.

The thus obtained seven types of coating compositions were measured by the following method for solids content (%) when applied, as well as the lightness L*, hue angle h and flip-flop (FF) value on an individual layer basis.

Solids content of the applied composition(%): solids content (%) 30 seconds after the application was measured as follows.

An aluminum foil whose mass was premeasured is covered with a flat magnet whose center was cut out in such a manner that an area sized 8 cm in crosswise×15 cm in lengthwise was exposed leaving the magnet's outer periphery intact, and a coating composition was applied to the exposed area. The flat magnet was removed 30 seconds after the application of the composition. The aluminum foil was immediately folded so that solvent did not further evaporate, and quickly measured for its mass. The aluminum foil was then opened, and the coating composition was heat-cured at 140° C. for 30 minutes, followed by measurement of the mass. The solids contents of the applied compositions were calculated from the masses of the coating compositions before and after curing and the premeasured mass of the aluminum foil itself.

The lightness L*, hue angle h and FF value on an individual layer basis: Each coating composition was applied to a thickness of 30 μm when cured to a tin plate on which a gray (N=5.5) film was preformed, allowed to stand at room temperature for 10 minutes, and then heat-cured at 140° C. for 30 minutes in a dryer oven with internal air circulation. The obtained coated plates were measured by the following method for lightness L*, hue angle h and FF value on an individual layer basis.

(a) Lightness L* measurement: L* value was measured at a light receiving angle of 45° with a multiangle spectrophotometer (tradename "MA-68", product of X-Rite).

(b) Hue angle h measurement: h was measured at a light receiving angle of 45° with a multiangle spectrophotometer (tradename "MA-68", product of X-Rite).

(c) FF value: L* values were measured at light receiving angles of 15° and 45° with a multiangle spectrophotometer (tradename "MA-68", product of X-Rite), and an FF value was calculated by numerical formula (1) above.

Table 1 shows the pigment, solvent composition and solids content (%) of applied coating composition as well as their lightness L*, hue angle h and FF values on an individual layer basis for each coating composition.

TABLE 1

| Colored base coating composition | | 1 | 2 | 3 | 4 | 5 | 6 | 7 |
|---|---|---|---|---|---|---|---|---|
| Pigment | Kind | A | B/C | A | D/b | D/b | D/b | A/E/F/c |
| | Amount | 3 | 3/3 | 10 | 0.5/7 | 0.5/7 | 0.5/7 | 0.1/2/2/7 |
| Solvent composition | | A | A | A | A | B | C | A |
| Solids content (%) after application | | 41.5 | 41.2 | 40.7 | 40.9 | 67.2 | 27.1 | 40.8 |
| L* | | 0.4 | 29.9 | 40.4 | 36.7 | 36.7 | 36.7 | 25.8 |
| h | | 169.4 | 75.0 | 303.5 | 48.3 | 48.3 | 48.3 | 23.9 |
| FF | | 0.47 | 0.04 | 1.85 | 1.40 | 1.40 | 1.40 | 0.76 |

In Table 1, the kind of pigment refers to those listed below. The amount of pigment is indicated per 100 parts (solids content) of resin component in each coating composition.

Coloring Pigments

A: Pigment Black 7, tradename "Monarch 1300", Cabot Corporation, carbon black pigment B: Pigment Red 254, tradename "Irgazin DPP RED BO", Ciba Specialty Chemicals, diketo pyrrolo pyrrole pigment C: Pigment Red 254, tradename "Irgazin DPP Rubine FTX", Ciba Specialty Chemicals, diketo pyrrolo pyrrole pigment D: Pigment Red 101, tradename "TRANSOXIDE RED", Dainichiseika Color & Chemicals Mfg. Co., Ltd., transparent iron oxide pigment E: Pigment Red 177, tradename "CHROMOPHTAL RED A2B", Ciba Specialty Chemicals, anthraquinone pigment F: Pigment Red 202, tradename "Quindo Magenta 202 RV6853", DAINIPPON INK AND CHEMICALS, INCORPORATED, Dichloroquinacridone pigment Luster Pigments a: Aluminum flake pigment, tradename "Alpaste 7640NS", TOYO ALUMINIUM K.K., solids content 65% b: Colored gold mica pigment, tradename "IRIODIN 303 W2", Merck Ltd., Japan c: Colored Red mica pigment, tradename "IRIODIN 504 W2", Merck Ltd., Japan Further, in Table 1, the solvent compositions are as follows.

A: Toluene/xylene/ethyl acetate/3-methoxybutyl acetate/diethylene glycol monobutyl ether acetate 3/16/28/13/2. This composition is a standard solvent composition to give a solids content of about 41% in an applied coating composition.

B: Toluene/xylene/ethyl acetate/diethylene glycol monobutyl ether acetate=3/16/51/2. This composition is for a fast-drying type solvent composition and has a higher ratio of solvents having low-boiling points.

C: Xylene/3-methoxybutyl acetate/diethylene glycol monobutyl ether acetate=16/44/2. This composition is a slow-drying type solvent composition and has a higher ratio of solvents having high-boiling points.

Production Example 9

Production of Top Clear Coating Composition

A clear coating composition (tradename "LUGA-BAKE CLEAR", Kansai Paint Co., Ltd., an acrylic resin/amino resin organic solvent-based clear coating composition) was diluted to an appropriate viscosity for application to prepare an organic solvent-based top clear coating composition with the solids content of about 30%.

Production Example 10

Production of Gloss Controlling Top Clear Coating Composition

A synthetic silica gloss control agent (tradename "MIZUKASIL P-526", a product of MIZUSAWA INDUSTRIAL CHEMICAL, LTD.) was added to a clear top coating composition (tradename "LUGA-BAKE CLEAR", a product of Kansai Paint Co., Ltd., an acrylic resin/amino resin organic solvent-based clear coating composition) in an amount of 15 parts (solids content) per 100 parts of resin component solids, mixed with stirring, and diluted to an appropriate viscosity for application, thereby obtaining an organic solvent-based gloss controlling top clear coating composition having a solids content of about 30%.

Examples 1 to 4 and Comparative Examples 1 to 3

A first colored base coating composition A shown in Table 2 was applied to a film thickness of 20 μm (when cured) using an spray gun over the entire intermediate coating film surface formed on the substrate obtained in Production Example 1, under the conditions of a booth temperature of 20° C. and a humidity of 60%. Coating composition A was selected from the above colored base coating compositions Nos. 1 to 3.

After application, the coating composition A was allowed to stand at room temperature for 4 minutes, and a second colored base coating composition B or B and C as shown in Table 2 was applied thereon using a spray gun equipped with four coating nozzles (tradename "S-type coater", NPC Incorporated) under conditions of a booth temperature of 20° C. and a humidity of 60% in such a manner that a part of the coating film surface of the first base coating composition remained exposed. Coating compositions B and C were selected from the above colored base coating compositions Nos. 4 to 7.

After application, the coating composition B or B and C were allowed to stand at room temperature for 10 minutes, and the top-clear coating composition obtained in Production Example 9 was applied over the entirety of these uncured coating film surfaces using an air spray gun to a film thickness of 35 μm when cured, under the conditions of a booth temperature of 20° C. and a humidity of 60%. After application, the thus coated substrate was allowed to stand at room temperature for 10 minutes and heated at 140° C. for 30 minutes to cure the first and second colored base coating films and clear coating film simultaneously, thereby obtaining a test substrate with a multi-layered patterned coating film formed thereon.

The obtained test substrate was measured for the proportion of exposed area (%) of the film of the coating composition A. More specifically, the proportion of the exposed area (%) of the coating film of the first colored base coating composition on the coated surface was measured by reading an image of the coated surface of the test substrate in the form of electronic data using an image scanner (tradename "CanoScan 4400F", Canon Inc.) into an image processing and analysis program (software "NIH Image", an image processing and analysis program developed by Wanye Rasband of the National Institutes of Health, U.S.).

Further, the lightness value difference ΔL*, hue angle value difference Δh, and flip-flop value difference ΔFF of any two coating compositions used in each example from coating compositions A, B and C were calculated based on the lightness L*, hug angle h and FF value of each of the individual coating films shown in Table 1.

Furthermore, pattern developing ability and three-dimensional pattern effects were examined as evaluation tests of the multi-layered patterned coating films formed on the test substrates in the following manner.

Pattern developing ability: Patterns are mainly expressed by the exposed area of the first colored base coating film and migration of the second colored base coating film. Favorable patterns are usually expressed when the proportion of the exposed area of the first colored base coating film is about 1 to about 95% and the solids content in an applied coating composition is about 30 to about 60%. The pattern developing ability is observed with naked eye based on an exposed area of the first colored base coating film and migration of the second colored base coating film, and evaluated as "excellent" when the exposure of the first colored base coating film and migration of the second colored based coating film are suitable, but evaluated as "poor" when the proportion of the exposed area is too small and with excessive migration.

Three-dimensional pattern effects: The three-dimensional effects such as depth and relief of patterned coating films were assessed with the naked eye, and whether the three-dimensional effects were excellent or poor was evaluated.

Table 2 shows the coating compositions used in each examples, exposed areas (%) of the coating composition A film, ΔL*, Δh and ΔFF of the two coating compositions from the coating compositions A, B and C used, and the evaluation results.

TABLE 2

| | | Example | | | | Comparative Example | | |
|---|---|---|---|---|---|---|---|---|
| | | 1 | 2 | 3 | 4 | 1 | 2 | 3 |
| First colored base coating composition | A | No. 1 | No. 1 | No. 2 | No. 3 | No. 1 | No. 1 | No. 1 |
| Second colored base coating composition | B | No. 4 | No. 4 | No. 4 | No. 4 | No. 4 | No. 5 | No. 6 |
| | C | — | No. 7 | No. 7 | No. 7 | — | — | — |
| Exposed area (%) of coating composition A film | | 8.5 | 8.1 | 8.6 | 4.5 | 0 | 8.5 | 8.2 |
| Coating compositions A and B | ΔL* | 32.7 | 32.7 | 6.8 | 3.7 | 32.7 | 32.7 | 32.7 |
| | Δh | 121.1 | 121.1 | 26.7 | 255.2 | 121.1 | 121.1 | 121.1 |
| | ΔFF | 0.93 | 0.93 | 1.35 | 0.45 | 0.93 | 0.93 | 0.93 |
| Coating compositions A and C | ΔL* | — | 21.8 | 4.1 | 14.6 | — | — | — |
| | Δh | — | 145.5 | 51.1 | 279.6 | — | — | — |
| | ΔFF | — | 0.29 | 0.72 | 1.09 | — | — | — |
| Coating compositions B and C | ΔL* | — | 10.9 | 10.9 | 10.9 | — | — | — |
| | Δh | — | 22.5 | 22.5 | 22.5 | — | — | — |
| | ΔFF | — | 0.64 | 0.64 | 0.64 | — | — | — |
| Pattern developing ability | | Excellent | Excellent | Exellent | Excellent | Poor | Poor | Poor |
| Three-dimensional pattern effects | | Excellent | Excellent | Excellent | Excellent | Poor | Poor | Poor |

Table 2 clearly demonstrates that the test substrates obtained in Examples 1 to 4 had patterned coating films with better pattern developing ability and three-dimensional pattern effects formed thereon than those obtained in the Comparative Examples. In Examples 1 to 4, use of a second colored base coating compositions containing luster pigments, in particular, is thought to have attributed to excellent three-dimensional pattern effects.

Examples 5 to 8

Test substrates with multi-layered patterned coating films formed thereon were obtained in the same manner as in Examples 1 to 4, except that the gloss controlling top clear coating composition obtained in Production Example 10 was used in place of the top clear coating composition obtained in Production Example 9.

The test substrates obtained in Examples 5 to 8 were then evaluated with naked eye in the same manner as above for their pattern developing abilities and three-dimensional pattern effects. As a result, patterned coating films with excellent pattern developing abilities and three-dimensional pattern effects were obtained as the test substrates obtained in Examples 1 to 4. The test substrates obtained in Examples 5 to 8 had patterned coating films with soft visual textures with suppressed glossiness.

The invention claimed is:

1. A method of forming a multi-layered patterned coating film comprising the steps of (1) applying a first colored base coating composition to a substrate, (2) applying a second colored base coating composition over the uncured coating film of the first colored base coating composition in such a manner that the first colored base coating film is partially exposed, wherein the second colored base coating composition forms a coating film of different color and/or visual texture from that formed by the first colored base coating composition, and wherein, 30 seconds after application of the second colored base coating composition, the solids content of the second colored base coating composition is 30 to 60 mass %, and (3) applying a top clear coating composition over the cured or uncured first and second colored base coating compositions, and curing the uncured composition(s).

2. A method of forming a coating film according to claim 1, wherein the second colored base coating composition is a luster coating composition.

3. A method of forming a coating film according to claim 1, wherein two or more kinds of coating compositions forming a coating film of different colors and/or visual textures are applied as the second colored base coating composition.

4. A method of forming a coating film according to claim 3, wherein a spray gun equipped with a plurality of coating nozzles is employed to apply the two or more kinds of coating compositions.

5. A method of forming a coating film according to claim 1, wherein the proportion of area exposed of the first colored coating film after the application of the second colored base coating composition is about 1% to about 95%.

6. A method of forming a coating film according to claim 1, wherein the colors and/or visual textures of the coating films obtained by individually applying the first and second colored base coating compositions meet at least one requirement selected from the group consisting of (i) the lightness value difference, $\Delta L^*$, is 5 or higher on the L*C*h Color Scale, (ii) the hue angle value difference, $\Delta h$, is 45 or higher on the L*C*h Color Scale, and (iii) the flip-flop value difference, $\Delta FF$, is 0.2 or higher.

7. A method of forming a coating film according to claim 1, wherein the uncured coating film of the first colored base coating composition in step (2) has a solids content of 40 mass % or greater.

8. A method of forming a coating film according to claim 1, wherein in step (3) the first and second colored base coating films are cured, and the top clear coating composition is then applied over these films and cured.

9. A method of forming a coating film according to claim 1, wherein in step (3) the first and second colored base coating composition films are left uncured, and the top clear coating composition is then applied over these coating films, and these three coating film layers are cured simultaneously.

10. A method of forming a coating film according to claim 1, wherein the top clear coating composition contains a gloss control agent.

11. A method of forming a coating film according to claim 1, wherein the substrate is an automotive body or automobile interior part.

* * * * *